United States Patent [19]

Lane

[11] Patent Number: 4,902,194

[45] Date of Patent: Feb. 20, 1990

[54] COLLECTING AND STACKING APPARATUS

[75] Inventor: Donald A. Lane, Wakefield, Mass.

[73] Assignee: Dennison Manufacturing Company, Framingham, Mass.

[21] Appl. No.: 214,028

[22] Filed: Jun. 27, 1988

[51] Int. Cl.[4] ..... B65H 29/24

[52] U.S. Cl. ..... 414/798.5; 271/197; 271/149; 271/221; 198/689.1

[58] Field of Search ..... 414/798.2, 798.5, 798.9, 414/788.9, 789.1; 271/196, 197, 149, 221, 181; 198/689.1

[56] References Cited

U.S. PATENT DOCUMENTS

| | | | |
|---|---|---|---|
| 2,421,874 | 6/1947 | Fouse | 414/798.5 X |
| 2,753,181 | 7/1956 | Arander | 271/196 X |
| 2,952,457 | 9/1960 | Fliegner | 271/197 X |
| 3,237,753 | 3/1966 | Allen et al. | 198/689.1 |
| 3,468,531 | 9/1969 | Whittington | 271/149 |
| 3,682,473 | 8/1972 | Kuyt | 271/179 X |
| 3,743,403 | 7/1973 | Sanza | 271/900 X |
| 3,774,783 | 11/1973 | Miller et al. | 271/181 X |
| 4,019,730 | 4/1977 | Staudinger et al. | 414/798.5 X |
| 4,062,535 | 12/1977 | Charbonnet | 271/197 X |
| 4,136,767 | 1/1979 | Sarovich | 198/689.1 X |
| 4,295,645 | 10/1981 | Nahar et al. | 271/149 X |
| 4,411,420 | 10/1983 | Louis et al. | 271/276 |
| 4,474,367 | 10/1984 | Jongerling et al. | 271/276 X |
| 4,558,944 | 12/1985 | Bothner | 271/197 X |
| 4,618,138 | 10/1986 | Silverberg | 271/197 X |

FOREIGN PATENT DOCUMENTS 2193951 2/1988 United Kingdom ..... 414/107

*Primary Examiner*—Robert J. Spar
*Assistant Examiner*—William M. Hienz
*Attorney, Agent, or Firm*—Arthur B. Moore; George E. Kersey; Mark Mastrianni

[57] ABSTRACT

Apparatus for collecting tickets cut from ticket stock, and for stacking these tickets in a horizontal array. Tickets are collected and oriented to stacking position by a vacuum transport belt assembly, and uniformly aligned by a horizontal stacker. The transport assembly is mounted on a housing which includes a vacuum drum to maintain ticket engagement with the transport belts, as the belts traverse a path having a horizontal to vertical orientation about the top and front of the housing. The stacker is mounted perpendicular to the front base of the housing and incorporates a stacking surface of rollers extending the length of, and parallel to the base of a side plate. The rollers are driven in a direction which, advantageously, positions tickets which may be of varying length against the side plate. Stacker infeed disks are mounted on the transport terminus roller in a unitary arrangement which both releases tickets from the transport and feeds tickets to the stacker, to improve processing efficiency. A friction-loaded back stop moveable along the stacking axis maintains successively fed tickets in an orderly array, due to cooperation of the stacking rollers and infeed disks. This arrangement enables continuous stacking operation, and reduces stacking apparatus sensitivity to variations in ticket size and composition.

7 Claims, 3 Drawing Sheets

FIG. 2
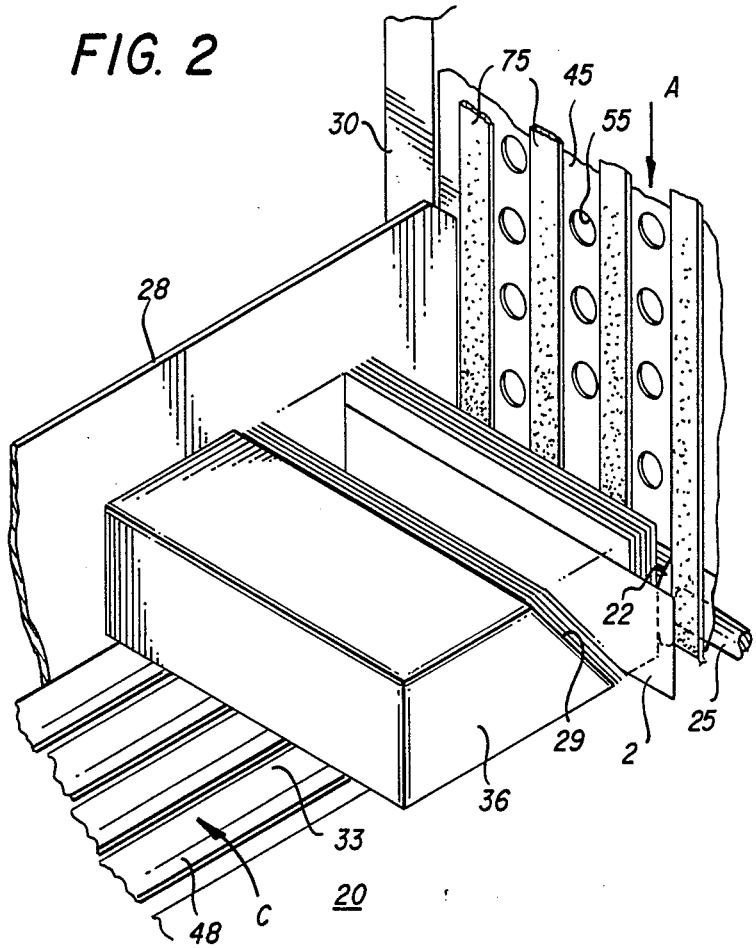
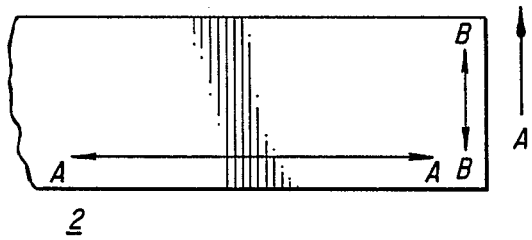
FIG. 3

COLLECTING AND STACKING APPARATUS

BACKGROUND OF THE INVENTION

This invention relates to generally to the art of collecting and stacking tickets or the like in a continuous operation. More particularly, this invention relates to a system for collecting tickets of equal or variable length severed from ticket stock, and for stacking these tickets on edge, in a horizontal array.

At the present time, numerous devices have been provided for use in conjunction with a ticket stock cutter to collect severed tickets in an orderly arrangement. These prior art devices are generally effective in performing collection and stacking operations, however they are characterized by sensitivity to variations in ticket stock, such as stock weight, relative moisture content and rigidity. Furthermore, they are generally characterized by extended processing cycles for collecting and stacking each ticket. These processing cycles often limit the severing rate of the ticket stock cutter. Consequently, it is desireable to remove collecting and stacking equipment sensitivities to stock variation, and to reduce the interval between successive ticket stacking cycles in order to allow the cutter to operate at maximum efficiency.

Accordingly, it is a primary object of the invention to increase the speed and efficiency of continuous operation of a ticket collecting and stacking system. A related object is to provide the capability of collecting and stacking a large number of tickets in continuous operation, independent of ticket length.

Another object of the invention is to provide apparatus which is not sensitive to variations in ticket stock.

A further related object is to provide efficient ticket stacking apparatus with a minimum of constituent parts, thereby lowering construction and maintenance costs.

SUMMARY OF THE INVENTION

In furthering the above and related objects, the ticket collection and stacking system of the invention collects tickets and orients tickets to stacking position, and uniformly aligns tickets of equal, or varying length into an array. The apparatus includes a vacuum transport belt assembly; a ticket stacker; and means for directing tickets from the transport to the stacker.

In accordance with one aspect of the invention, apparatus for stacking tickets comprises a side plate; a stacking surface with a plurality of rollers parallel to the side plate; an infeed disk assembly for feeding tickets on edge to the input end of the stacking surface; a friction-loaded back stop moveable along the stacking axis and means to drive the rollers wherein rollers are rotated to urge tickets against the side plate.

The stacking surface desireably comprises a plurality of substantially adjacent, horizontal rollers of equal length and radius mounted on a housing located below the rollers, and means for rotating the rollers synchronously. The infeed disk assembly desireably comprises a plurality of squared-corner disks mounted on a spindle attached at the input end of the stacking surface. In addition, the apparatus can further comprise a vacuum transport belt assembly which is mounted in front of the stacker, and in which the terminus of the transport is located at the input end of the stacker. Tickets can be collected from a cutter and fed to the stacker, and the terminus drive roller of the vacuum transport belt can include the infeed disks to couple the ticket collection means with the feeding means.

In an improved apparatus for processing tickets severed from a cutter to provide an array of tickets of the type including apparatus for collecting tickets and orienting tickets into stacking position, and apparatus for stacking tickets on edge in a horizontal array, the improvement can comprise improved stacking system, including a side plate; a stacking surface with a plurality of rollers parallel to the side plate; an infeed disk assembly for routing successive tickets on edge to the input end of the stacking surface; a friction-loaded back stop moveable along the stacking axis and means to drive the rollers wherein rollers are rotated in a direction to urge tickets against the side plate.

The stacking surface can include a plurality of substantially adjacent, horizontal rollers of equal length and radius mounted on a housing located below the rollers, and means for rotating the rollers synchronously. The infeed disk assembly can include a plurality of squared-corner disks mounted on a spindle attached at the input end of the stacking surface.

The vacuum transport belt assembly can comprise a housing with top and front surfaces having portions defining an opening at the intersection of the top and front surfaces and these surfaces having aperatures forming an air pervious grid; a transport belt terminus drive roller mounted at the base of the housing front surface, having equally spaced annular grooves located to define a series of belt pulley and infeed disk structures; a transport belt idler roller, mounted at the rear edge of the housing top surface, having grooves corresponding to the location of the belt pulleys on the drive roller; a drum having aperatures forming an air pervious grid about the circumferential surface of the drum, the drum rotatably mounted in a horizontal position with its longitudinal axis parallel with the front of the housing and the drum surface circumferentially tangental to the top and front surface edges proximate to the opening; a plurality of continuous belts suspended about the top surface, the 90° circumference of the drum exposed at the opening, and the front surface of the housing; a means for continuously evacuating the housing to subatmospheric and a means for driving the drive roller.

In accordance with one aspect of the invention, tickets are received in a horizontal orientation by the transport belts after they have been severed by a cutter. The tickets are retained on the outer face of the transport belts by proximity of the spacing between belts to the air pervious grid. Tickets are moved along the top horizontal transport path of the housing by the belts and remain in contact with the belts as the belts and tickets pass over the vacuum drum to the vertical path along the front of the transport housing.

In accordance with another aspect of the invention, the transport belt drive pulleys and the infeed disks are commonly mounted on the transport belt terminus roller located at the input end of the stacker. Infeed disks are preferably positioned between each belt pulley and preferably project slightly above the belt surface. Tickets upon encountering the infeed disks are lifted from the transport belt vacuum and fed into the input end of the stacker. This arrangement synchronizes the transport drive with the feeding mechanism thus reducing stacker cycle time and avoiding complicated coupling arrangements.

In accordance with a further aspect of the invention, the tickets are collected on edge in a horizontal stacker which consists of a side plate and a stacking surface defined by parallel, adjacent rollers. Tickets are fed in a vertical orientation, on edge, into the stacker by the infeed disks where tickets are aligned against the side plate by rotation of the rollers against the ticket edges. Successively directed tickets facilitate stacking by driving the furthermost substantially vertically oriented tickets against the backstop. The backstop is friction mounted to minimize stacking forces, obviating the need for complicated biasing assembly.

BRIEF DESCRIPTION OF THE DRAWINGS

The above and additional aspects of the invention are illustrated with reference to the detailed description which follows, taken in conjunction with the drawings in which:

FIG. 2 is a partial perspective view of the horizontal stacker;

FIG. 3 is a partial plan view of illustrative ticket stock;

DETAILED DESCRIPTION

Figure 1:
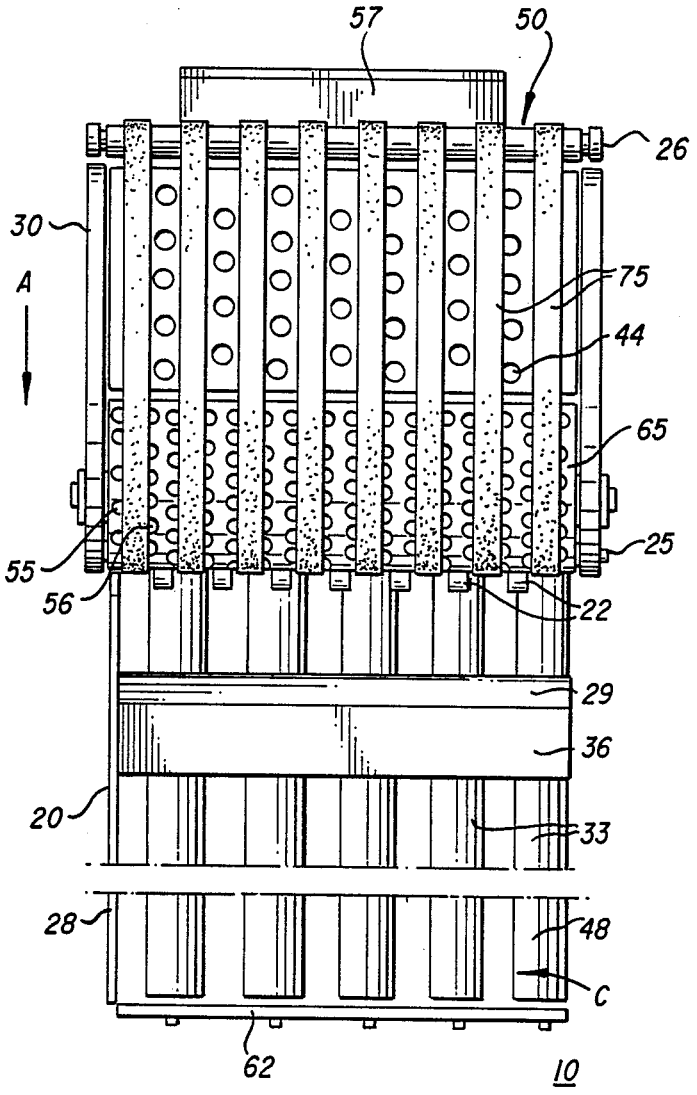
FIG. 1 is a plan view of conveying and stacking apparatus in accordance with the preferred embodiment.

Illustrative apparatus for collecting and stacking tickets cut from a strip of ticket stock in accordance with the invention is shown in the plan view of FIG. 1. The ticket processing apparatus 10 includes a vacuum transport belt assembly 50, housing assembly 30, and a horizontal stacker 20 for stacking tickets 2 fed by the infeed disks 22. Tickets 2 severed by a cutter are collected at the input end of the transport belt assembly 50. The vacuum transport belts 75 are driven in Direction A by drive roller 25. Tickets 2 are retained on the belts 75 by suction along the aperature grid of the top 44 and front 45 housing 30 surfaces and the circumferential surface of the drum 65, as the transport belts 75 convey tickets 2 in Direction A. Tickets 2 collected in horizontal orientation along the top 44 pass over the drum 65 during transfer whereupon they assume vertical orientation as they are moved along the front 45 housing 30 by the transport belts 75. These tickets 2 are released from the transport vacuum by infeed disks 22 as the tickets 2 reach the terminus of the transport, and are directed to the input end of the stacker 20. Successive tickets 2 directed to the stacker 20 horizontally accumulate.

FIG. 3 illustrates a severed ticket 2 to be collected by apparatus 10. Tickets 2 horizontally aligned along axis A—A are collected by apparatus 10 and moved in Direction A. The apparatus 10 is compatible with a variety of ticket 2 lengths, as measured along axis A—A, and ticket 2 widths as measured along axis B—B. Additionally, apparatus 10 will accomodate a variety of tags, labels and the like.

The collecting and stacking system is readily described with reference to the plan view of FIG. 1. Upon being severed by a cutter (not shown), tickets 2 in a horizontal orientation are collected at the input end of the vacuum transport belt assembly 50 on a plurality of continuous, adjacent transport belts 75; these belts 75 are suspended about the housing 30 by a rotatably mounted drive roller 25, a rotatably mounted idler roller 26 and a rotatably mounted drum 65. Adjacent belts 75 are advantageously spaced apart from each other a distance which is approximately equal to the belt width; belt spacing and support is effected by corresponding grooves 23 which seat the belts 75 in the idler roller 26 and drive roller 25. Refering to FIG. 1, seven belts are shown in the prefered illustrated embodiment; alternatively, the number of belts may be adjusted to adapt the apparatus to other applications.

The top 44 and front 45 housing 30 surfaces having aperatures 55 defining an air pervious grid, intersect to define an opening; the drum 65, having aperatures 56 about the circumferential surface forming an air pervious grid, is rotatably mounted in a horizontal position within the opening, such that the longitudinal axis of the drum 65 is parallel with the front 45 of the housing 30.

The positional relationship between the drum 65 surface and the top 44 and front 45 housing 30 surfaces is such that the drum 65 surface is circumferentially tangental to the top 44 and front 45 housing 30 surface edges proximate to the opening. Thus, the drum 65 circumference traverses the 90° arc between the top 44 and front 45 surfaces, so that there is a substantially continuous, air pervious surface area from the top 44 to the front 45 of the housing 30.

The endless transport belts 75 extend around the drive roller 25 and idler roller 26, and the drum 65, passing across the top 44 and front 45 surfaces of the housing 30. The housing 30 is continuously evacuated by a fan 57 during operation to reduce the pressure in the housing 30 to subatmospheric. The belts 75 are sufficiently spaced apart so that the vacuum along the contiguous air pervious surfaces firmly retains tickets 2 on the belts 75.

Figure 4:
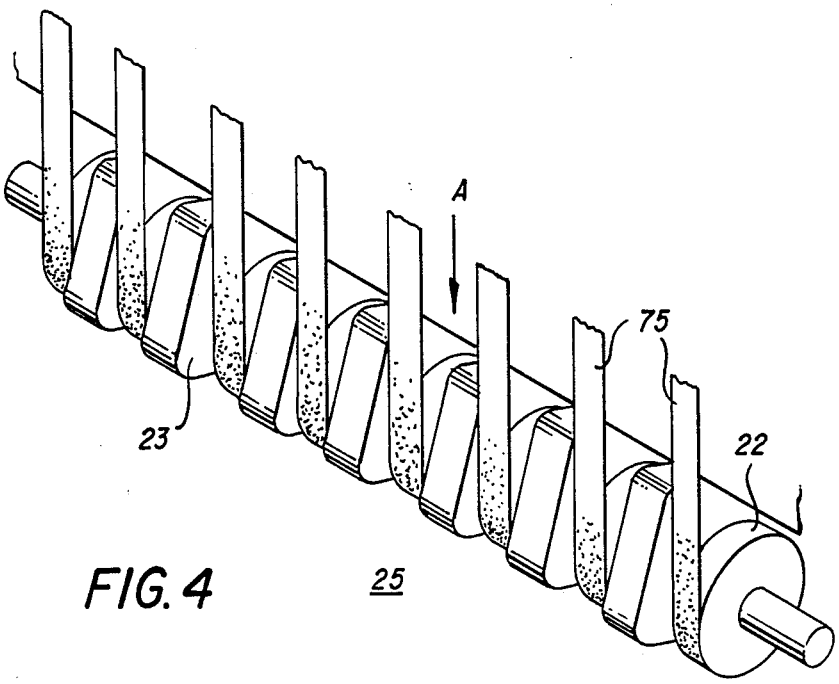
FIG. 4 is a perspective view of the drive roller and infeed disks.
Figure 5:
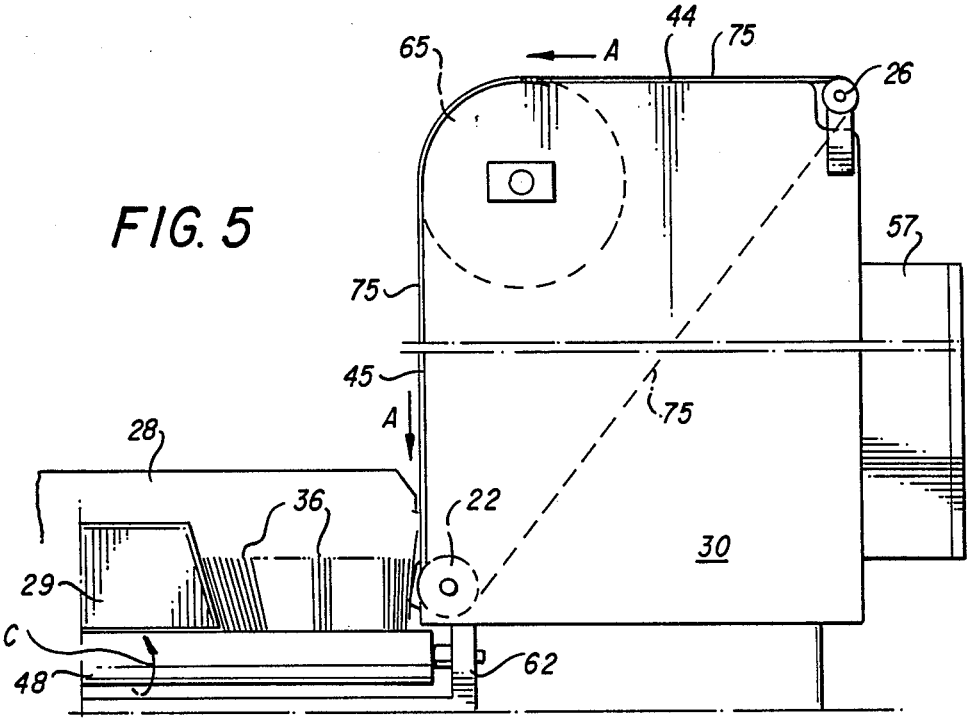
FIG. 5 is a side view of the apparatus in FIG. 1.

As shown in FIG. 2, the transport belt terminus drive roller 25 is rotatably mounted at the base of the front housing 30 surface, at the input end of the stacker 20. Infeed disks 22, as best seen in FIG. 4, fixed to the drive roller 25 in a spaced horizontal arrangement, are positioned between the belts 75. The infeed disks 22 have a width which is essentially equal to, and in fact, establishes, the space between the stacking belts. In the illustrated prefered embodiment, as depicted in FIGS. 2 and 4, the disks 22 are square cornered, having a radius sufficient to extend the disks above the belt surface, for effecting the release of tickets 2 from the vacuum along the front housing 30 surface. This occurs when vertically oriented tickets 2, upon encountering the infeed disks 22 as tickets 2 move along on belts 75 in direction A, are directed away from the belt surface and thereupon break free of the vacuum. The infeed disks 22 further urge tickets 2 downward, at the input end of the stacker 20, and desireably, in the direction of the back stop 36 to faciliate stacking.

In the preferred embodiment of the stacker 20 illustrated in FIG. 2, a side plate 28 is mounted on a horizontal supporting structure 62 of generally rectangular configuration. The side plate 28 is approximately the height of a single ticket 2, and is perpendicular in relation to the lower portion of the front housing 30. The stacking surface 33, which is approximately the width of a single ticket, has a plurality of essentially adjacent, horizontally oriented stacking rollers 48 of equal length and radius rotatably mounted on the supporting structure 62, parallel with the bottom of the side plate 28. In the illustrated preferred embodiment of the invention, five stacking rollers are provided; nevertheless, as with the number of belts, the number and corresponding radius of stacking rollers 48 may be altered to increase or decrease the frictional contact, to adapt the apparatus for the processing of other materials. The stacking rollers 48 are rotated in unison, in Direction C. The rollers may be synchronized by a gear drive arrangement, or other suitable means. Tickets 2 are routed in a vertical orientation, on edge, into the horizontal stacker 20 by the infeed disks 22 and are aligned against the side plate 28 by rotation of the stacking rollers against the ticket 2 edges. It should be understood that the stacking rollers 48 and drive roller 25 would most likely be commonly driven.

As shown in FIG. 2, a friction-loaded back stop 36 is mounted on a structure permitting horizontal movement along the stacking axis. The back stop face 29, is angled from vertical, slightly toward the stacking direction, in part, to accomodate the projection of the infeed disks 22, at the input end of the stacker 20. Tickets 2, successively directed to the stacker 20 by the infeed disks 22, are driven toward the furthermost tickets 2 against the back stop 36, facilitating orderly stacking. This arrangement, with the cooperation of the stacking rollers 48 in also reducing friction drag along the stacking axis, obviates the need for a more involved biasing assembly, and provides efficient, continuous stacking.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

We claim:

1. Apparatus for stacking tickets in a horizontal array, comprising:

a horizontal stacking area having an input end and bordered by a side plate extending along a horizontal stacking axis;

a back stop for retaining tickets stacked on edge in the stacking area, said back stop being movable away from the input end to accommodate variable numbers of tickets;

a plurality of disks mounted on a roller at said input end, said roller and disks being driven so as to urge tickets into the input end;

a vacuum transport belt assembly, comprising movable transport belts for conveying tickets and releasing them at the disks;

a housing having top and front surfaces with a plurality of apertures forming an air pervious grid, the top and front surfaces defining an opening;

a rotatable drum having a plurality of apertures forming an air pervious grid in its periphery, the drum being located within the opening with its circumference proximate to the front and top housing surfaces; and means for evacuating the housing to subatmospheric wherein said transport belts travel in a path around said top housing surface, said rotatable drum, said front housing surface, and said roller, wherein said transport belts advance the tickets along a path past said top housing surface, said rotating drum, and said front housing surface, to said roller.

2. Apparatus as defined in claim 1, wherein the back stop is friction loaded and angled from a vertical orientation.

3. Apparatus as defined in claim 1, wherein the disks are square-cornered.

4. Apparatus as defined in claim 1 wherein the disk roller comprises a terminus drive roller for the transport belts, mounted at the bottom of the housing front surface.

5. Apparatus as defined in claim 1, wherein a 90 degree expanse of the rotatable drum is exposed at the housing opening.

6. Apparatus as defined in claim 1, wherein tickets are fed by the transport belts with the tickets' long axis substantially perpendicular to the transport belts.

7. Apparatus as defined in claim 1 wherein the housing includes a plenum chamber.

* * * * *